US009474325B2

(12) United States Patent
Bodmer

(10) Patent No.: US 9,474,325 B2
(45) Date of Patent: Oct. 25, 2016

(54) HEEL JACK

(76) Inventor: E. James Bodmer, Gold Canyon, AZ (US)

( * ) Notice: Subject to any disclaimer, the term of this patent is extended or adjusted under 35 U.S.C. 154(b) by 460 days.

(21) Appl. No.: 13/464,392

(22) Filed: May 4, 2012

(65) Prior Publication Data

US 2012/0279084 A1 Nov. 8, 2012

Related U.S. Application Data

(60) Provisional application No. 61/483,450, filed on May 6, 2011.

(51) Int. Cl.

| | |
|---|---|
| ***A43B 7/14*** | (2006.01) |
| ***A43B 7/16*** | (2006.01) |
| ***A43B 21/26*** | (2006.01) |

(52) U.S. Cl.

CPC ..... *A43B 7/1405* (2013.01); *A43B 7/16* (2013.01); *A43B 21/26* (2013.01)

(58) Field of Classification Search

CPC ..... A43B 7/16; A43B 7/38; A43B 7/20; A43B 23/088; A43B 23/10; A43B 23/14; A43B 23/16; A43B 23/17; A43B 11/00; A43B 11/02; A61F 5/14; A61F 5/0111; A61F 5/0113

USPC ..... 36/81, 92, 93, 38, 170, 27, 88, 89, 105, 36/68, 69

See application file for complete search history.

(56) References Cited

U.S. PATENT DOCUMENTS

| | | | | |
|---|---|---|---|---|
| 178,387 | A * | 6/1876 | Simpson | 36/68 |
| 1,205,206 | A * | 11/1916 | Hofmeister | 36/89 |
| 2,399,543 | A * | 4/1946 | Dack | 36/106 |
| 2,994,326 | A * | 8/1961 | Hack | 36/170 |
| 4,223,457 | A | 9/1980 | Borgeas | |
| 5,152,082 | A * | 10/1992 | Culpepper | 36/89 |
| 5,435,079 | A | 7/1995 | Gallegos | |
| 5,475,935 | A * | 12/1995 | Frost | 36/89 |
| 5,561,920 | A * | 10/1996 | Graham et al. | 36/27 |
| 5,645,525 | A | 7/1997 | Krivosha | |
| 5,680,714 | A * | 10/1997 | Lopez | 36/27 |
| 5,729,917 | A * | 3/1998 | Slepian et al. | 36/27 |
| 5,852,886 | A | 12/1998 | Slepian et al. | |
| 5,865,778 | A * | 2/1999 | Johnson | 602/27 |
| 5,946,827 | A * | 9/1999 | Okajima | 36/58.5 |
| 5,987,780 | A | 11/1999 | Lyden et al. | |
| 6,018,892 | A * | 2/2000 | Acheson et al. | 36/89 |
| 6,115,942 | A * | 9/2000 | Paradis | 36/27 |
| 6,216,365 | B1 | 4/2001 | Cohen | |
| 6,393,731 | B1 | 5/2002 | Moua et al. | |
| 6,557,271 | B1 * | 5/2003 | Weaver, III | 36/27 |
| 6,775,927 | B2 | 8/2004 | Glicksman | |
| 6,848,201 | B2 | 2/2005 | Staffaroni et al. | |
| 6,925,732 | B1 * | 8/2005 | Clarke | 36/27 |
| 7,056,299 | B2 | 6/2006 | Brown et al. | |
| 7,168,188 | B2 * | 1/2007 | Auger et al. | 36/69 |
| 7,228,648 | B2 | 6/2007 | Yang | |
| 7,254,906 | B2 * | 8/2007 | Morris et al. | 36/28 |
| 7,555,847 | B2 * | 7/2009 | Kendall | 36/27 |

(Continued)

*Primary Examiner* — Khoa Huynh

*Assistant Examiner* — Megan Brandon

(74) *Attorney, Agent, or Firm* — Polster, Lieder, Woodruff & Lucchesi, L.C.

(57) ABSTRACT

An improved construction for a device intended to raise the heel or heels of a user up off an associated shoe to diminish or eliminate pain and discomfort. The device is adjustable to accommodate a variety of applications and is transferable between those applications.

16 Claims, 4 Drawing Sheets

(56) References Cited

U.S. PATENT DOCUMENTS

| | | | | |
|---|---|---|---|---|
| 7,793,438 | B1 * | 9/2010 | Busse et al. | 36/105 |
| 8,069,585 | B2 * | 12/2011 | Rohwer-Kahlmann | 36/27 |
| 8,763,278 | B2 * | 7/2014 | McKay | 36/93 |
| 2003/0188455 | A1 * | 10/2003 | Weaver, III | 36/27 |
| 2004/0068893 | A1 * | 4/2004 | Kendall | 36/88 |
| 2005/0102857 | A1 * | 5/2005 | Yen | 36/28 |
| 2005/0126044 | A1 * | 6/2005 | Langley | 36/89 |
| 2005/0138846 | A1 * | 6/2005 | O'Connor | 36/72 B |
| 2007/0261272 | A1 * | 11/2007 | Hurd et al. | 36/92 |
| 2008/0000106 | A1 * | 1/2008 | Culpepper | 36/89 |
| 2009/0000150 | A1 * | 1/2009 | Wong | 36/89 |
| 2010/0043254 | A1 * | 2/2010 | Dobbin et al. | 36/114 |
| 2012/0058316 | A1 * | 3/2012 | Cherneski | 428/197 |
| 2012/0131819 | A1 * | 5/2012 | Loverin | 36/35 R |
| 2012/0285040 | A1 * | 11/2012 | Sievers | 36/27 |

* cited by examiner

HEEL JACK

CROSS-REFERENCE TO RELATED APPLICATIONS

This application claims the benefit of provisional patent application Ser. No. 61/483,450 filed May 6, 2011.

STATEMENT REGARDING FEDERALLY SPONSORED RESEARCH

None.

BACKGROUND OF THE INVENTION

The present disclosure relates to a cushioning, shock absorbing device adaptable for use in a variety of situations to cup and support a user's heel or heels, suspending the heel above an associated shoe or shoes, for example, when weight is applied to the device. While the device is described in particular detail to the human foot heel, those skilled in the art will recognize the wider application of the inventive concepts disclosed hereinafter.

When people stand, walk or run they exert pressure on their heel. The device disclosed takes pressure off the heel, thereby diminishing or eliminating pain and discomfort many people experience while standing, walking or running. Prior heel support devices typically provide flexible cushioning materials as a part of a shoe and/or as an insert to a particular type of shoe. Other prior devices provide shoes that contain an integral and non-removable foot support structure that is installed as a unit into a shoe which is not transferable to other shoes. Still other prior art devices typically use spring structures of various forms constructed as part either the shoe insole itself or as a supplemental insert positioned adjacent to the insole.

There is a need for an adjustable heel support for supporting the heel independently of the shoe insole. There also is a need for a heel support device which is transferable between various shoes and is adaptable to fit various widths of shoes. There is a need for such a support device which is also adjustable longitudinally to provide adjustability of support along the length of the user's foot. A need also exists for a device in which the cushioning member is replaceable and adjustable in applicational use.

BRIEF SUMMARY OF THE INVENTION

In accordance with this disclosure, generally stated, a support and cushioning device having a simplified construction is provided which includes a flexible support member having a predetermined shape, the flexible member being designed for insertion into a second article, the second article conventionally being used to support the heel equivalent of a limb. A flexible cushioning member is provided having a plurality of ends, at least two of said ends being attached to the flexible member in a manner to cushion the heel and prevent and/or reduce contact of the heel with the second article in the application and use of the device. The support member is compatible with a plurality of second articles, and both the support member and the cushioning member preferably are adjustable in use. For the purposes of this disclosure the support and cushioning device is denominated as a "heel jack."

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the described constructions without departing from the scope of the invention, it is intended that all matter contained in the following description or shown in the accompanying drawings shall be interpreted as illustrative and not in a limiting sense.

Figure 1:
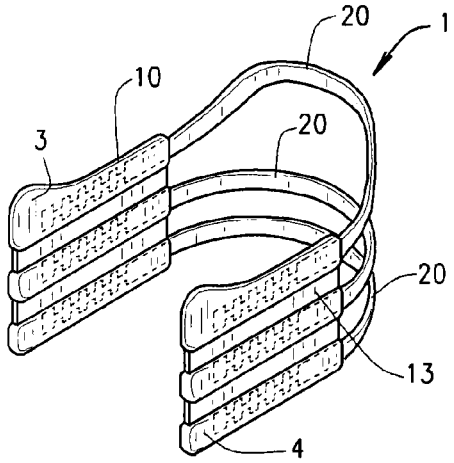
FIG. 1 is a view in perspective of one illustrative embodiment of heel jack of the present disclosure.
Figure 5:
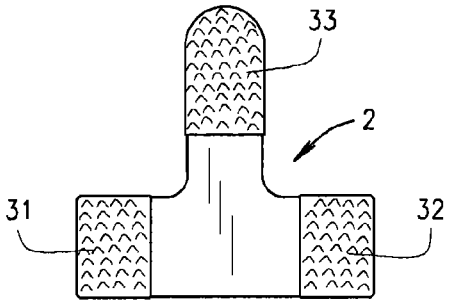
FIG. 5 is a view in perspective of one illustrative embodiment of the flexible heel support employed with the embodiment of FIG. 1.

Referring now to FIG. 1, one illustrative embodiment of heel jack of the present invention is shown preferably to comprise a support structure or element 1 and a heel support or cushion 2 (FIG. 5).

The support a structure 1 includes, in the embodiment illustrated, a pair of opposed wing members 3 and 4 respectively. The wing members preferably are constructed from a moldable material, and various forms of plastic or other synthetic material, for example, polypropylene, latex, rubber or other similar moldable and/or thermoplastic materials work well. Those skilled in the art will recognize that materials other than the materials listed may be used, if desired. The wing members 3 and 4 preferably are interchangeable with one another, and may be formed from a single mold during manufacture. In addition, the wings themselves may be coated with a soft coating of a non abrasive material not shown, for example, a latex or foam rubber coating to increase the comfort level of the structure 1 in use. The wing members 3 and 4 define an open mouth 5 generally sized to accept the heel portion of the user's foot, as latter described in greater detail.

Each of the wing members 3 and 4 has a plurality of generally parallel spaced apart channels 10 formed in it. The channels 10 also preferably have a plurality of serrations 11 formed in them. The outward facing area between the spaced channels 10 are intended to receive elongated strips of a hook and loop fastening (Velcro®) material 13. The material 13 is attached to the wing members by any convenient method. Adhesive works well, for example. Other fastening devices and methods will be apparent to those skilled in the art, and another novel method is described in greater detail below.

A plurality of support arms 20 extend from and between the wings 3 and 4. Each of the support arms 20 have respective first and second ends which engage the channels 10 in respective ones of the wing members 3 and 4. In the embodiment illustrated, preferably one of the support arms 20 assumes a shape corresponding to the contour of a typical shoe of the wearer. As will be appreciated, other shapes may be employed if desired.

The support arms 20 may be constructed from a variety of materials. I have found that the spring steel works well, but those skilled in the art will recognize that other materials may be employed for the arms 20 in other embodiments of the support element 1.

Each end of the members 20 have a plurality of protrusions 25 formed in them, which are sized both for reception in the channels 10 and for frictional engagement with the serrations 11 of the respective wing members 3 and 4.

Figure 2:
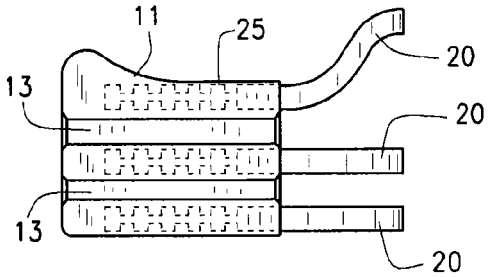
FIG. 2 is a view in side elevation of the embodiment shown in FIG. 1.
Figure 3:
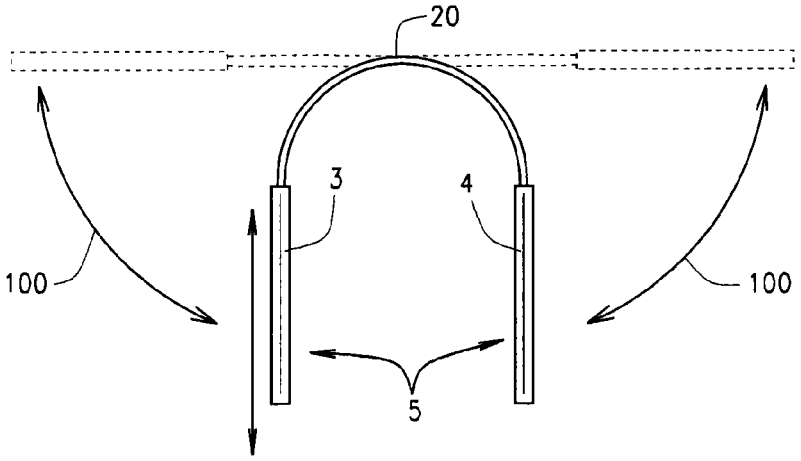
FIG. 3 is a top plan view illustrating the flex pattern of the device shown in FIG. 1.
Figure 4:
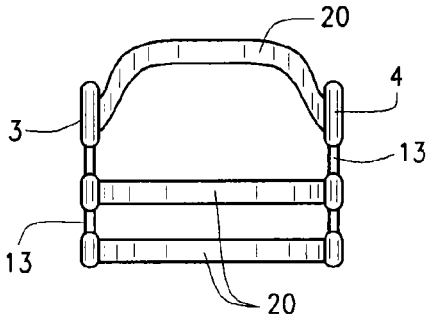
FIG. 4 is a view rear elevation of the heel jack of FIG. 1.

The support element 1 is adjustable for reception in a number of various size shoes, and may be transferred between shoes by the user. For example, as shown in FIGS. 2 and 3, the support element 1 is adjustable axially along the members 20 through the engagement of various ones of the protrusions 25 and the serrations 11. Because the position of the members 3 and 4 with respects to the length of the members 20 control the stiffness or flexibility of the members 20, the relative position of the members 20 and the wing members 3,4 also controls the flexibility of the heel jack. Thus movement of the members 20 provides both adjustment of the mouth 5 thereby making a larger heel silhouette insertable in the support element 1 while also permitting the heel jack to support and cushion a longer portion of the heel as the arm 20 movement adjusts the length and width provided by the support element 1 at the same time. At least some adjustment is an important aspect of the present disclosure in that it enables the support 1 to be used in a plurality of different shoe sizes and shoe designs, merely by making the adjustment between the support arms 20 and the wings 3 and 4 varies the flexibility of the design as illustratively shown by a plurality of positions along the spread angles 100. As later described, and shown in FIG. 3, even without adjustment between the wings and the support members 20, the members 20 themselves provided rotational movement about a length or longitudinal axis along the spread angles 100, regardless of whether or not the additional adjustment provided by axial movement of the arms 20 and the wings is provided in a particular embodiment of the disclosure.

As illustrated in FIG. 5, one illustrative embodiment of heel supporting member or cushion 3 is shown to have an elongated T-shape, delineated by a first arm 31, a second arm 32 and a third arm 33. Each end of the arms 31, 32, and 33 has conventional hook and eye 35 material attached to them, enabling the heel support 30 to be removably secured to the support element 1. Again, attachment of the material 35 to the member 2 may be accomplished by any conventional method. Through the material 35, the arms 31, 32 may be mounted to the hook and eye material 13 along the wings 3 and 4, while the arm 33 may be attached to itself around at least one of the members 20 to provide a heel supporting a position for the combined components. It should be appreciated by those skilled in the art the heel support 3 may be adjusted along the channels 13 to vary the height of the member 2 with respect to the wings of 3 and 4, while the end 33 may be adjusted along the support members 20 to position the heel support 2 properly with respect to and in consideration of a user's physical characteristics and/or the intended use of the device. While the heel supporting member or cushion 3 in the embodiments illustrated is described as being or having a "T" shape, a variety of other design silhouettes are compatible with the broader aspects of the disclosure.

Figure 6:
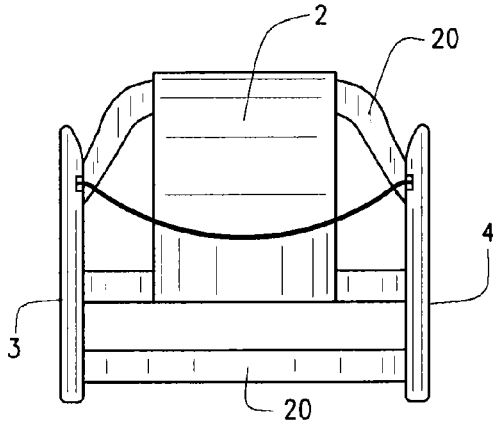
FIG. 6 is a front plan view of a second illustrative embodiment of the heel jack of the present invention.
Figure 7:
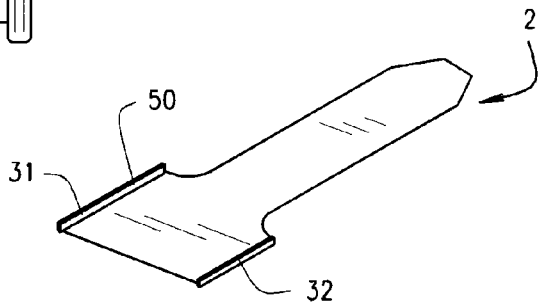
FIG. 7 is a plan view of a second illustrative embodiment of the flexible heel support employed with the embodiment of FIG. 6.
Figure 8:
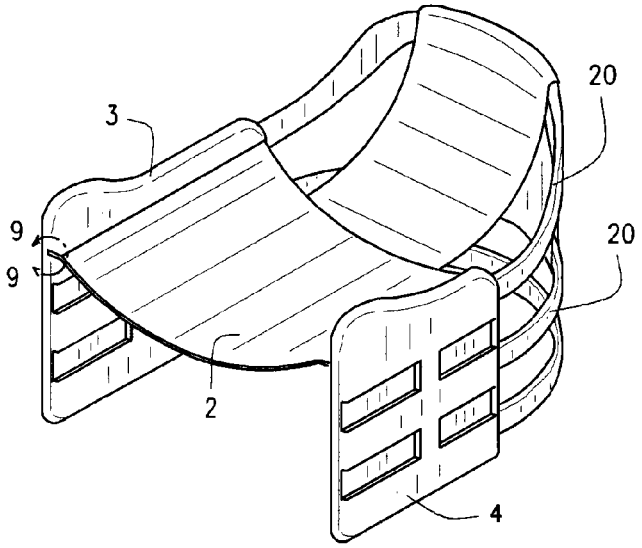
FIG. 8 is a view and perspective of the second illustrative embodiment of the heel jack of the present invention shown in FIG. 6.
Figure 9:
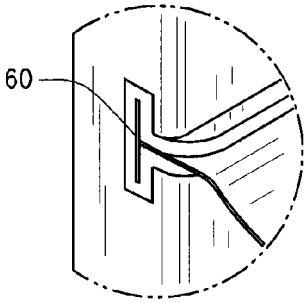
FIG. 9 is an enlarged view taken about the line 9-9 of FIG. 8.

Referring now to FIGS. 6, 8 and 9, a second attachment method of the heel support or cushion 2 is shown in greater detail. As there shown, the wings 3 and 4 again have a plurality of support arms 20 extending between them. In this embodiment, however, the arms 20 are encapsulated within the support wings 3 and 4. While this embodiment is not as adjustable as the embodiment of FIG. 1, the arms 20 still are flexible enough to vary the size of the mouth 5 to accommodate the need of the user. The heel support or cushion 2 again preferably is T-shaped, but the ends of the arms 31 and 32 are crimped to provide a rail 50. The rail 50 then is inserted along a mating channel 60 formed in the wings 3 and 4, as best seen in FIG. 9. The end 33 of the heel support 3, in the embodiment illustrated, may use a hook and eye fastening system for attachment to and release from a selected one of the arms 20. However, other fastening methods, including various conventional clips or a simple hook type fastener or hanger type hook may be used, if desired.

Figure 10A:
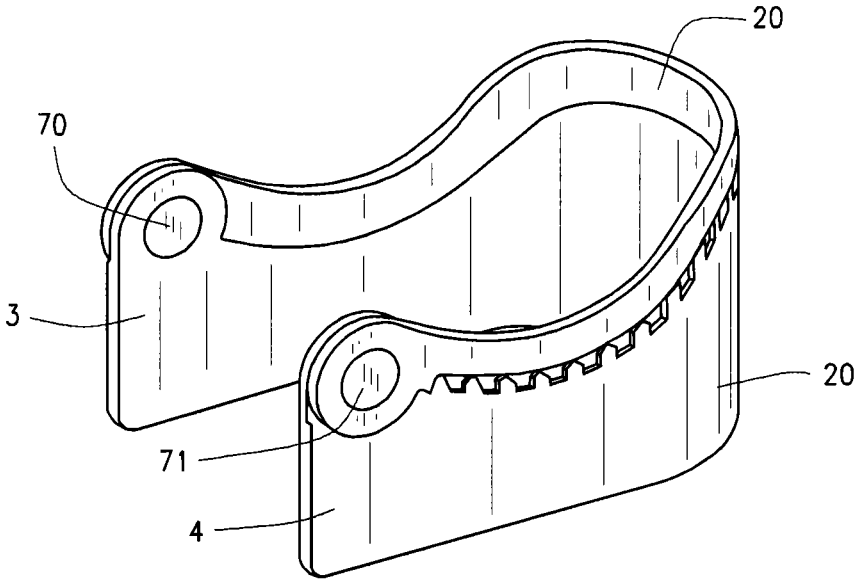
FIGS. 10*a* and 10*b* show a third illustrative third embodiment of the heel jack of the present invention.
Figure 10B:
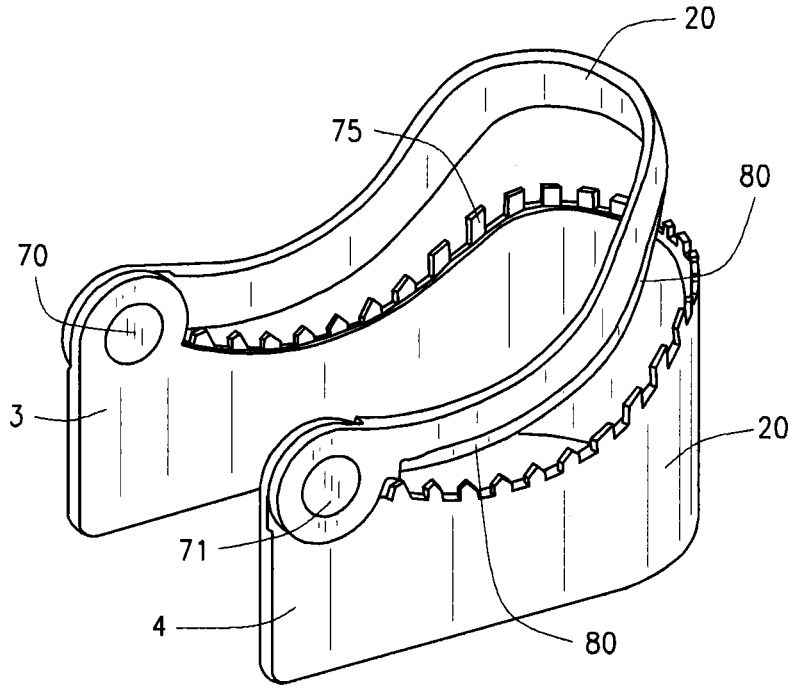
Figure 11:
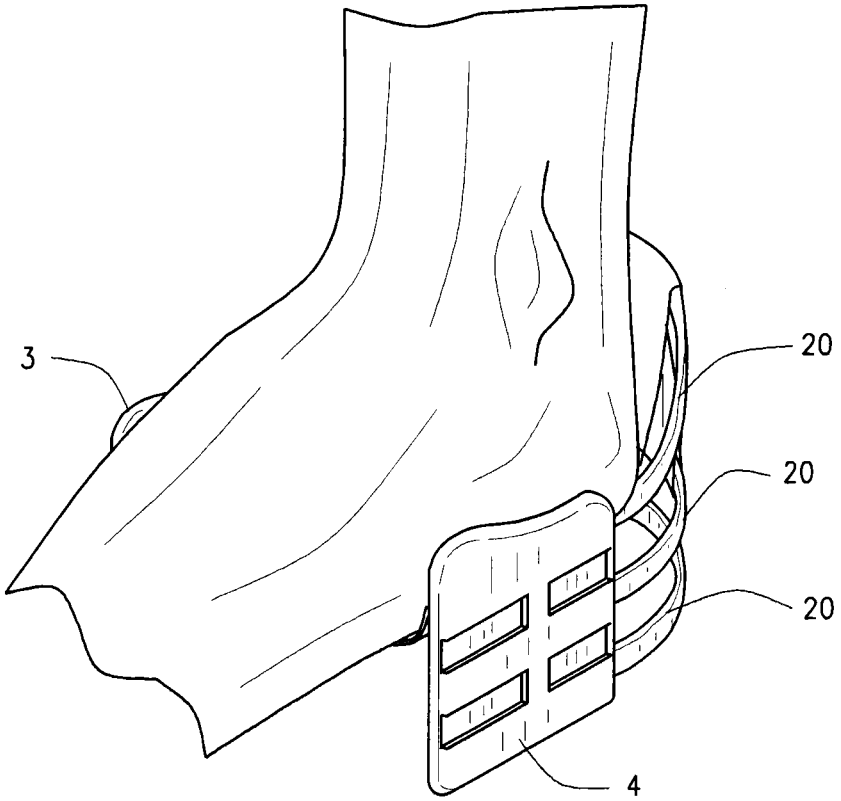
FIG. 11 is a view in perspective, partly broken away, illustrating one application for the heel jack of this invention.

FIGS. 10*a* and 10*b* illustrate a third illustrative embodiment of the heel jack of the present invention. In the embodiment of FIG. 10, the wings 3 and 4 have a pair of members 20 associated with the wings. One of the members 20 is preferably integrally formed with the wings. A second member 20 is pivotally mounted to wings 3 and 4 at a pivot point 70 and 71 respectively. The integrally formed member 20, in the embodiment shown in FIG. 10*b* has a plurality of teeth 75 formed in it. The second member 20, which as indicated above is rotatably mounted to the rings 3 and 4, has a groove or channel 80 formed it which is sized to receives a teeth 75 in a friction fit. The channel 80/teeth 75 interaction permits the heel support member 2 to be crimped between the rotatable member 20 and the lower member 20 or to slide into a channel on the under portion of the second member 20. While a friction fit between the arm members 20 is described, As shown in the various embodiments, the support structure or element 1 is generally U-shaped; however it may take any shape, such as oval, square or a rectangle. The support structure 1 is intended to make contact with the heel counter on the inner portion of the shoe of the user, for example. It may be further secured to the heel counter of the shoe with hook and eye material (Velcro®), although in the embodiments shown in FIGS. 1 and 8, the spring material utilized for the support arms 20 enable the device to be frictionally engaged with the inner portion of the shoe in a friction fit. The preferred U-shape coupling component is the shape of a person's heel. (See FIG. 11) As indicated above, at least the wings can be molded, contoured or indented depending on the shoe needed. As further indicated above, it is preferable that the support element 1 is adjustable, to accommodate a range of length, but as shown in FIG. 8 and FIG. 11, a single length device may be provided, if desired.

The support element 1 function is to support and suspend the flexible member 2 when weight is supplied by a person's heel. While various materials may be in employed in construction, the support element 1 should be strong enough to withstand forces applied to it. As will be appreciated by those skilled in the art, this will vary from one person to another depending on weight, age, shoe size and type and whether the device is used merely for standing, walking or running. In any event, the support 1 should not be allowed to invert, bend, crack or break. The flexible heel support or cushion 2 is used to cushion the heel. That is accomplished in the various embodiments by keeping the member 2 suspended between the wings 3 and 4 and the support arms 20 forming the U-shape. As best seen in FIG. 11, the flexible member 2 function is to cup and support the person's heel, suspend the heel and keep the heel generally from touching the shoe when weight it applied to it by the user. Various materials may be used for the heel support or cushion 2, but I have found that a latex material works well for the intended purpose. While the intent of the support 1 is to eliminate contact between the heel and the shoe, for example, some contact may be acceptable depending of the physical characteristics of the user and/or the condition being treated through use of the support element 1. As will be appreciated, the member 2 is intended to be replaceable, and the flexibility of the member 2 may be varied to accomplish the intended use.

As indicated above, the support element 1 fits inside the shoe against the heel counter. It cups the outer edges of the person's heel. The flexible member 2 in turn is supported during application use. The support element 1 and flexible member 2 are all necessary for proper function. As will be appreciated by those skilled in the art, additional ankle stabilization elements can be added for use with the above described structural elements, if desired. An ankle stabilization element will be necessary if there is no heel counter in application use or if the device is used in other areas or other medical purposes.

Numerous variations within the scope of the appended claims will be apparent to those skilled in the art. In addition to the various examples given throughout the description, it will be apparent that various dimensions, materials and shapes may be altered in other embodiments. For example, the cushion 2 may have differing thicknesses associated with it to facilitate use of the device described. While a latex construction for the cushion 2 is preferred, other elastic or flexible materials are compatible with the broader aspects of the disclosure. In view of the above, it will be seen that the several objects and advantages of the present invention have been achieved and other advantageous results have been obtained.

I claim as my invention:

1. A heel support and cushioning device used in combination with a footwear, wherein the footwear having a length axis, comprising: at least a pair of oppositely opposed wing members, each of the wing members having a plurality of axially extending channels formed in them, the number of wing member channels corresponding to the number of pre-shaped support arms, the wing members being adjustably spaced from one another to adapt to a variety of heel sizes; a plurality of pre-shaped support arms, each support arm having respective first and second ends attached to respective ones of said opposed wing members along said channels, the support arms being adjustable horizontally inwardly toward and outwardly from one another with said wing members in a rotational plane about the length axis of the footwear to define a first adjustment for the device along a plurality of selectable spread angle positions capable of definition by the rotation of the support arms about the length axis to permit the wing members to accept a variety of heel sizes; and a cushioning member having a plurality of ends, the cushioning member arranged for supporting a heel, two of said respective ends of said cushioning member being attached to at least one of respective ones of the opposed wing members and said support arms and being suspended therefrom, the cushioning member being mounted for independent adjustment of the cushioning member in a direction perpendicular to the length axis of the footwear to define a second adjustment for the device.

2. The device of claim 1 wherein at least two of said support arms are adjustably mounted to their respective wing member channels to permit linear lateral axial movement between at least first and second positions of said wing member with respect to its associated support arm along the length axis of the second structure thereby providing a third adjustment and adjustable position for the device.

3. The device of claim 2 wherein each of said support arms generally has a U-shaped configuration.

4. The device of claim 3 wherein the wing members and the U-shaped support arms define an open mouth, and the opening of the mouth is adjustable as the support arms are rotated inwardly toward and outwardly from one another in the plane parallel to the length axis of the second structure to define a plurality of heel receiving support positions.

5. The device of claim 4 wherein the cushioning member is flexible T-shape and is constructed from latex.

6. The device of claim 5 wherein the two respective ends of said cushioning member are removeably mounted to their respective wing member and support arm.

7. The device of claim 6 wherein the support arms are constructed from spring steel.

8. The device of claim 7 further including at least three support arms respectively attached to said wing members, the channels in each of said wing members being sized to receive an end of each of said support arms in an adjustable arrangement.

9. The device of claim 8 wherein said cushioning member further includes a third end removeably attached to at least one of said support arms.

10. A heel support and cushioning device to use in combination with a shoe of the user, the shoe having a length axis, and the device being removably mounted in the heel portion of the shoe of the user, comprising: a flexible support arm having a predetermined shape for insertion in the heel portion of the shoe, the support arm having a first end and a second end defining an open mouth channel, the first and second ends of the support arm being adjustable inwardly toward and outwardly from one another in a plane generally parallel to and about the length axis of the shoe to vary the size of the channel mouth defined by the respective first and second ends so as to define a plurality of independent spread angle positions defining one or more channel mouths for accepting a variety of heel sizes of the user so as to define a first adjustment for the device; a wing, the wing having a channel formed in it for receiving an end of the support arm, the wing and support arm being adjustable with respect to one another along the length axis of the shoe; and a flexible cushioning member having a plurality of ends, at least two of said ends being attached to the support arm across the open mouth of the channel, the cushioning member being both removably attached to the support arm and independently vertically adjustable in a direction perpendicular to the length axis of the shoe across the open mouth of the channel.

11. The device of claim 10 wherein the support arm has a U-shape configuration.

12. The device of claim 11 wherein the cushioning member is constructed from latex.

13. A support and cushioning device, comprising: at least one support arm having a predetermined shape, the support arm being capable of use independently of a footwear and being insertable into a footwear, the footwear having a length axis, the cushioning device being configured to support a body part of a user, the at least one support arm having a first end and a second end, the first and second ends of the support arm being adjustable horizontally inwardly toward and outwardly from one another in a rotational plane about to the length axis of the footwear to define a first adjustment for the device along a plurality of spread angle positions capable of definition by the rotation of the first and second ends about the length axis; a flexible cushioning member having a plurality of ends, at least two of said ends being attached to at least one support arm along the support arm opposite ends so as to support the body part above at least one support surface, the two ends of the cushioning member being removeably mounted to the opposite ends of the support arms and being independently vertically adjustable with respect to the support arms along the opposite ends of the support arm with respect to the at least one support surface to define a second adjustment for the device; and a wing member having a channel attached to each end of said support arm, the support arm ends being adjustably mounted into the channel of its respective wing member so as to permit linear lateral axial movement between at least first and second positions of said wing member with respect to its associated support arm along the length axis of the second structure, thereby providing a third adjustable position for the device.

14. The device of claim 13 wherein at least one support arm has a U-shape configuration.

15. The device of claim 14 wherein the cushioning member has a T-shape and is constructed from latex.

16. The device of claim 15 wherein the second article is a shoe, the shoe having a predetermined length axis and the support arm is linearly adjustable with respect to the length axis.

* * * * *